US010090096B2

(12) United States Patent
Inui

(10) Patent No.: US 10,090,096 B2
(45) Date of Patent: Oct. 2, 2018

(54) COMMON MODE CHOKE COIL

(71) Applicant: MURATA MANUFACTURING CO., LTD., Kyoto-fu (JP)

(72) Inventor: Masaki Inui, Kyoto-fu (JP)

(73) Assignee: Murata Manufacturing Co., Ltd, Kyoto-fu (JP)

( * ) Notice: Subject to any disclaimer, the term of this patent is extended or adjusted under 35 U.S.C. 154(b) by 0 days.

(21) Appl. No.: 14/887,892

(22) Filed: Oct. 20, 2015

(65) Prior Publication Data

US 2016/0133374 A1 May 12, 2016

(30) Foreign Application Priority Data

Nov. 10, 2014 (JP) ..... 2014-227795

(51) Int. Cl.
*H01F 27/29* (2006.01)
*H01F 17/00* (2006.01)

(52) U.S. Cl.
CPC ..... *H01F 27/292* (2013.01); *H01F 17/0013* (2013.01); *H01F 2017/002* (2013.01); *H01F 2017/0093* (2013.01)

(58) Field of Classification Search
CPC ..... H01F 2027/2809; H01F 17/0013; H01F 2017/002; H01F 27/2804; H01F 17/0006; H01F 2017/0093
USPC ..... 336/200
See application file for complete search history.

(56) References Cited

U.S. PATENT DOCUMENTS

2003/0134612 A1* 7/2003 Nakayama ..... H01F 17/0013 455/307
2003/0193386 A1* 10/2003 Tseng ..... H01F 27/2804 336/200
2011/0074535 A1* 3/2011 Banno ..... H01F 27/292 336/192

FOREIGN PATENT DOCUMENTS

JP H0388308 U * 9/1991 ..... H01F 17/00
JP 2001-044033 A 2/2001
JP 2001044033 A * 2/2001 ..... H01F 17/00
JP 2003-068528 A 3/2003
JP 2007067214 A * 3/2007 ..... H01F 1/20
(Continued)

OTHER PUBLICATIONS

JP2001044033A, Feb. 2001, Machine Translation.*
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A common mode choke coil includes a laminated-type coil that has high breakdown voltage reliability. Coil conductors and a coil conductor for a secondary coil are laminated so as to be respectively interposed between, coil conductors for a primary coil, two coil conductors connected to each other by an inner circumferential side via hole conductor and two coil conductors connected by an inner circumferential side via hole conductor. Meanwhile, in the primary coil, an outer circumferential side via hole conductor is provided so as to pass through only one insulation layer, and accordingly, a length of the outer circumferential side via hole conductor in an axis line direction thereof is reduced. As a result, an amount of conductive material used for the outer circumferential side via hole conductor that diffuses during firing
(Continued)

can be reduced, and a drop in a thickness of the insulation layers can be suppressed.

3 Claims, 10 Drawing Sheets

(56) References Cited

FOREIGN PATENT DOCUMENTS

JP 2013-138146 A 7/2013

OTHER PUBLICATIONS

JP2007067214A, Mar. 2007, Machine Translation.*
Notification of the Second Office Action issued by the State Intellectual Property Office of the People's Republic of China on Dec. 4, 2017, which corresponds to Chinese Patent Application No. 201510684651.1 and is related to U.S. Appl. No. 14/887,892.

* cited by examiner

COMMON MODE CHOKE COIL

CROSS REFERENCE TO RELATED APPLICATIONS

This application claims benefit of priority to Japanese Patent Application No. 2014-227795 filed Nov. 10, 2014, the entire content of which is incorporated herein by reference.

TECHNICAL FIELD

This disclosure relates to common mode choke coils, and particularly relates to a common mode choke coil including a laminated-type coil.

BACKGROUND

A common mode choke coil including a laminated-type coil includes a multilayer body having a laminated structure with a plurality of laminated insulation layers, and a coil is provided within the multilayer body. The coil includes a plurality of spiral-shaped coil conductors. Each of the plurality of coil conductors has an inner circumferential side end portion located relatively near a central area of the insulation layers and an outer circumferential side end portion located relatively near an outer edge of the insulation layers, with an inner circumferential side via hole conductor being connected to the inner circumferential side end portion and an outer circumferential side via hole conductor being connected to the outer circumferential side end portion. To create a portion in the coil having mutually opposite winding directions, the plurality of coil conductors are connected in series by alternately using the inner circumferential side via hole conductors and the outer circumferential side via hole conductors so that the inner circumferential side end portions are connected to each other by the inner circumferential side via hole conductors and the outer circumferential end portions are next connected to each other by the outer circumferential side via hole conductors.

Japanese Unexamined Patent Application Publication No. 2003-68528 and Japanese Unexamined Patent Application Publication No. 2001-44033, for example, disclose common mode choke coils of interest in the context of this disclosure.

Japanese Unexamined Patent Application Publication No. 2003-68528 and Japanese Unexamined Patent Application Publication No. 2001-44033 disclose forming a primary coil by forming a spiral-shaped coil conductor on an insulation layer, laminating a plurality of these insulation layers together, and connecting the plurality of coil conductors in series through via hole conductors, and forming a secondary coil by forming a spiral-shaped coil conductor on an insulation layer, laminating a plurality of these insulation layers together, and connecting the plurality of coil conductors in series through via hole conductors.

The common mode choke coil disclosed in Japanese Unexamined Patent Application Publication No. 2003-68528 in particular has a structure in which a portion where only the plurality of insulation layers for the primary coil are laminated and a portion in which only the plurality of insulation layers for the secondary coil are laminated are disposed so as to be isolated from each other.

On the other hand, the common mode choke coil disclosed in Japanese Unexamined Patent Application Publication No. 2001-44033 has a structure in which the insulation layers for the primary coil and the insulation layers for the secondary coil are laminated in an alternating manner, or in other words, a structure in which coil conductors for the primary coil and coil conductors for the secondary coil are laminated in an alternating manner.

According to the common mode choke coil disclosed in Japanese Unexamined Patent Application Publication No. 2003-68528, the primary coil and the secondary coil are positioned so as to be isolated from each other, resulting in a weak coupling between the primary coil and the secondary coil. There is thus a problem that desired characteristics are difficult to achieve.

As opposed to this, the common mode choke coil disclosed in Japanese Unexamined Patent Application Publication No. 2001-44033 has a structure in which the coil conductors for the primary coil and the coil conductors for the secondary coil are laminated in an alternating manner, and thus a relatively strong coupling can be achieved between the primary coil and the secondary coil. However, in the case where this type of alternating laminated structure is employed, a via hole conductor that connects coil conductors for one of the coils will unavoidably pass through two insulation layers that form a boundary surface along which a coil conductor for the other coil extends, which may cause problems such as those described below.

FIG. 7 illustrates a cross-sectional view of a part of a common mode choke coil employing an alternating laminated structure, and specifically illustrates a portion in which are located two adjacent coil conductors 1 and 2 for a first coil and a via hole conductor 3 that connects the coil conductors 1 and 2, along with several insulation layers 4 to 8 and a coil conductor 9 for a second coil. Although not illustrated in FIG. 7, the coil conductor for the second coil extends at least along a boundary surface between the insulation layers 5 and 6.

As illustrated in FIG. 7, a via pad 3*a* is formed at each boundary surface position between the insulation layers 5 to 7 so as to extend outward around the via hole conductor 3. Although formed at the same time as when a conductive paste for the via hole conductor 3 is applied, the via pad 3*a* contributes to an increase in the reliability of the connection between the via hole conductor 3 and the coil conductors 1 and 2, as well as an increase in the reliability of the connection of the via hole conductor 3 at the boundary surface between the insulation layers 5 to 7, even if, for example, skew in the lamination of the insulation layers 4 to 7 has arisen. As such, the via pad 3*a* normally tends to have a greater thickness than the thicknesses of the coil conductors 1 and 2.

In the case where an alternating laminated structure is employed, the via hole conductor 3 that connects the coil conductors 1 and 2 to each other is provided so as to pass through the two insulation layers 5 and 6 as mentioned above. Three via pads 3*a* overlap in the lamination direction as a result. This in turn results in a greater length of the via hole conductor 3 in the axis line direction than in the case where a via hole conductor passes through one insulation layer only, which means that a greater amount of conductive material provided for the via hole conductor 3 and the via pad 3*a* is present near the via hole conductor 3.

In the case where the insulation layers 4 to 8 are formed from a glass ceramic material, for example, a firing process is carried out during the manufacture of the common mode choke coil. In the firing process, the conductive material for the via hole conductor 3 and the via pad 3*a* normally diffuses into the insulation material provided for the insulation layers 4 to 8. As described above, there is a greater amount of conductive material in the structure illustrated in FIG. 7 than in the case where the via hole conductor passes through a single insulation layer only, and thus the amount of diffused conductive material is greater in the structure illustrated in FIG. 7.

Meanwhile, in the process for manufacturing the common mode choke coil, a process for pressing the insulation layers 4 to 8 in the lamination direction is carried out in a stage before the firing in order to increase the tightness of the lamination. The conductive material used for the via hole conductor 3 and the via pad 3*a* is less susceptible to compression deformation due to the pressing process than the insulation material used for the insulation layers 4 to 8. As such, the insulation layer 7, for example, is compressed more at areas where the via hole conductor 3 and the via pad 3*a* are located, and a thickness T of the insulation layer 7 at these areas becomes significantly lower than the original thickness of the insulation layer 7. The same drop in thickness can occur in the insulation layer 4 as well.

The stated conductive material diffusion, drop in thickness of the insulation layers 4 and 7, and so on become factors leading to a drop in the breakdown voltage reliability of the common mode choke coil. In the case where a conductor that can generate a potential difference between itself and the via hole conductor 3 and the via pad 3*a*, such as the coil conductor 9 for the second coil, for example, is formed on a top surface side of the insulation layer 7 as illustrated in FIG. 7 so as to be located on a line extending from an axis line of the via hole conductor 3, the breakdown voltage reliability between the coil conductor 9 and the via pad 3*a* becomes a concern. Purely from the standpoint of conductive material diffusion, the same breakdown voltage reliability problem can arise in the case where an outer terminal electrode (not shown) that can generate a potential difference between itself and the via hole conductor 3 and the via pad 3*a* is located near the via hole conductor 3 or the via pad 3*a*.

The via hole conductor 3 illustrated in FIG. 7 can be the inner circumferential side via hole conductor that connects the inner circumferential side end portions of the coil conductors 1 and 2 to each other or the outer circumferential side via hole conductor that connects the outer circumferential side end portions of the coil conductors 1 and 2 to each other. It is particularly difficult to avoid the aforementioned breakdown voltage reliability problem in the case where the via hole conductor 3 is the outer circumferential side via hole conductor. A reason for this will be described next.

First, assume that insulation layers 11 to 15, illustrated in FIG. 8, are laminated in that order from the bottom to form the multilayer body of the common mode choke coil.

A spiral-shaped coil conductor 16 for a primary coil is formed on the insulation layer 11, a spiral-shaped coil conductor 17 for a secondary coil is formed on the insulation layer 12, a spiral-shaped coil conductor 18 for the primary coil is formed on the insulation layer 13, a spiral-shaped coil conductor 19 for the secondary coil is formed on the insulation layer 14, and a spiral-shaped coil conductor 20 for the primary coil is formed on the insulation layer 15.

In FIG. 8, an inner circumferential side end portion of the coil conductor 16 on the insulation layer 11 and an inner circumferential side end portion of the coil conductor 18 on the insulation layer 13 are connected to each other by an inner circumferential side via hole conductor 21 as indicated by a dashed line. An outer circumferential side end portion of the coil conductor 18 on the insulation layer 13 and an outer circumferential side end portion of the coil conductor 20 on the insulation layer 15 are connected to each other by an outer circumferential side via hole conductor 22. On the other hand, an outer circumferential side end portion of the coil conductor 17 on the insulation layer 12 and an outer circumferential side end portion of the coil conductor 19 on the insulation layer 14 are connected to each other by an outer circumferential side via hole conductor 23. The stated inner circumferential side via hole conductor 21 passes through the two insulation layers 12 and 13, the outer circumferential side via hole conductor 22 passes through the two insulation layers 14 and 15, and the outer circumferential side via hole conductor 23 passes through the two insulation layers 13 and 14.

Such connections are also realized in coil conductors that are not illustrated. For example, the inner circumferential side end portion of the coil conductor 17 on the insulation layer 12 and the inner circumferential side end portion of the coil conductor on the insulation layer laminated to the bottom of the insulation layer 11 are connected by an inner circumferential side via hole conductor 24, and the inner circumferential side end portion of the coil conductor 19 on the insulation layer 14 and the inner circumferential side end portion of the coil conductor on the insulation layer laminated to the top of the insulation layer 15 are connected by an inner circumferential side via hole conductor 25.

Consider the inner circumferential side via hole conductor 21 and the outer circumferential side via hole conductor 23 as representative examples. A positional relationship between the inner circumferential side via hole conductor 21 and the coil conductor 19 is similar to a positional relationship between the via hole conductor 3 and the coil conductor 9 illustrated in FIG. 7. Likewise, a positional relationship between the outer circumferential side via hole conductor 23 and the coil conductor 20 or the coil conductor 16 is similar to the positional relationship between the via hole conductor 3 and the coil conductor 9 illustrated in FIG. 7. As such, the aforementioned breakdown voltage reliability problem can arise in either case.

However, with respect to the positional relationship between the inner circumferential side via hole conductor 21 and the coil conductor 19 mentioned first, it is relatively easy to ensure that the coil conductor 19 is not located on a line extending from the axis line of the inner circumferential side via hole conductor 21. FIG. 9 illustrates the insulation layers 13 and 14 illustrated in FIG. 8. Shifting the inner circumferential side via hole conductor 21 to a position in the insulation layer 13 indicated by a broken line, for example, can ensure that the coil conductor 19 formed in the insulation layer 14 thereabove is not located on a line extending from the axis line of the inner circumferential side via hole conductor 21. There is a relatively large open space in the central area of the insulation layer, and thus it is relatively easy to change the position of the inner circumferential side via hole conductor as described above.

On the other hand, with respect to the positional relationship between the outer circumferential side via hole conductor 23 and the coil conductor 20 or the coil conductor 16 mentioned after, it is not easy to ensure that the coil conductor 20 or the coil conductor 16 is not located on a line extending from the axis line of the outer circumferential side via hole conductor 23. FIG. 10 illustrates the insulation layers 14 and 15 illustrated in FIG. 8. To ensure that the coil conductor 20 formed on the insulation layer 15 is not located on a line extending from the axis line of the outer circumferential side via hole conductor 23, it is necessary to shift the outer circumferential side via hole conductor 23 to one of several positions in the insulation layer 14 indicated by the broken lines. However, shifting the position of the outer circumferential side via hole conductor 23 leads to issues such as interference with an intermediate portion of the coil conductor 19, straddling an edge of the insulation layer 14, and so on. In other words, within the limited surface area of the insulation layer 14, it is not easy to ensure that the coil conductor 20 (or the coil conductor 16) is not located on a line extending from the axis line of the outer circumferential side via hole conductor 23 without reducing the number of turns in the coil.

The problem of reduced breakdown voltage reliability caused by the conductive material diffusion, a drop in thickness of the insulation layers, and so on with respect to the outer circumferential side via hole conductors as described above results in a drop in the degree of freedom with which the shape of the coils in the common mode choke coil can be designed. However, increasing the thickness of the insulation layers in order to increase the breakdown voltage reliability poses an obstacle to the miniaturization of the common mode choke coil.

SUMMARY

Accordingly, it is an object of this disclosure to provide a structure for a common mode choke coil capable of solving the aforementioned problems.

A common mode choke coil according to a preferred embodiment of this disclosure includes a multilayer body having a laminated structure provided with a plurality of laminated insulation layers, first and second coils provided within the multilayer body, and first to fourth outer terminal electrodes provided on an outer surface of the multilayer body. The first and second outer terminal electrodes are electrically connected to one end and another end, respectively, of the first coil, and the third and fourth outer terminal electrodes are electrically connected to one end and another end, respectively, of the second coil.

The first and second coils each include a plurality of spiral-shaped coil conductors that extend along a plurality of boundary surfaces between the insulation layers and that have an inner circumferential side end portion located relatively near a central area of each of the insulation layers and an outer circumferential side end portion located relatively near an outer edge area of each of the insulation layers, and an inner circumferential side via hole conductor that connects the respective inner circumferential side end portions of coil conductors adjacent in the lamination direction to each other.

The first coil further includes an outer circumferential side via hole conductor that connects the respective outer circumferential side end portions of coil conductors adjacent in the lamination direction to each other, and in the first coil, the plurality of coil conductors are connected in series through the inner circumferential side via hole conductor and the outer circumferential side via hole conductor in an alternating manner.

To solve the aforementioned problem, this disclosure has a first feature in which the coil conductors for the second coil include such a coil conductor that is laminated so as to be interposed between two coil conductors, of the coil conductors for the first coil, that are connected to each other by the inner circumferential side via hole conductor. To rephrase, the first feature is that, of the coil conductors for the first coil, several sets of coil conductors connected to each other by inner circumferential side via hole conductors are positioned so as to sandwich only one insulation layer with a coil conductor for the second coil. This contributes to strengthening coupling between the first coil and the second coil.

Furthermore, this disclosure has a second feature in which, in the first coil, the outer circumferential side via hole conductor is provided so as to pass through only one insulation layer. To rephrase, this second feature is that coil conductors connected to each other by the outer circumferential side via hole conductor are positioned so as to sandwich only one insulation layer, and thus a length of the outer circumferential side via hole conductor in an axis line direction thereof can be reduced. As a result, an amount of conductive material used for the outer circumferential side via hole conductor that diffuses during a firing process can be reduced, and a drop in a thickness of the insulation layers caused by the outer circumferential side via hole conductor during a pressing process can be suppressed.

According to a preferred embodiment of this disclosure, it is preferable that the aforementioned feature configuration given to the first coil be also given to the second coil. In other words, the second coil also further includes an outer circumferential side via hole conductor that connects the respective outer circumferential side end portions of coil conductors adjacent in the lamination direction to each other, and in the second coil, the plurality of coil conductors are connected in series through the inner circumferential side via hole conductor and the outer circumferential side via hole conductor in an alternating manner. The coil conductors for the first coil include such a coil conductor that is laminated so as to be interposed between two coil conductors, of the coil conductors for the second coil, that are connected to each other by the inner circumferential side via hole conductor. In the second coil as well, the outer circumferential side via hole conductor is provided so as to pass through only one insulation layer.

According to the above preferred configurations, in both the first and second coils, an amount of conductive material used for the outer circumferential side via hole conductor that diffuses during firing can be reduced, and a drop in a thickness of the insulation layers caused by the outer circumferential side via hole conductor during pressing can be suppressed, and furthermore, coupling between the first coil and the second coil can be strengthened.

According to a preferred embodiment of this disclosure, it is preferable that a form of the first coil and a form of the second coil be symmetrical relative to the lamination direction. Through this, directivity when mounting the common mode choke coil can be eliminated.

According to preferred embodiments of this disclosure, the diffusion of conductive materials, a drop in the thickness of an insulation layer, and so on caused by the outer circumferential side via hole conductor can be suppressed while maintaining a relatively strong coupling between the first coil and the second coil. Accordingly, even if a conductor that can generate a potential difference between itself and the outer circumferential side via hole conductor is disposed in or near a line extending from an axis line of the outer circumferential side via hole conductor, there is less concern of a drop in breakdown voltage reliability. As such, the degree of freedom with which the coil shapes can be designed in the common mode choke coil can be increased. In addition, the degree of freedom with which a positional relationship between the outer terminal electrodes and the outer circumferential side via hole conductors can be designed can be increased as well. Furthermore, it is not necessary to increase the thickness of the insulation layers in order to increase the breakdown voltage reliability, which eliminates an obstacle to the miniaturization of the common mode choke coil.

Furthermore, according to preferred embodiments of this disclosure, as will be described later with reference to FIG. 4, changing the lamination order of the coil conductors for the first coil and the coil conductors for the second coil makes it possible to adjust a characteristic impedance of the common mode choke coil with ease.

Other features, elements, characteristics and advantages of the present disclosure will become more apparent from the following detailed description of preferred embodiments of the present disclosure with reference to the attached drawings.

DETAILED DESCRIPTION

Figure 1:
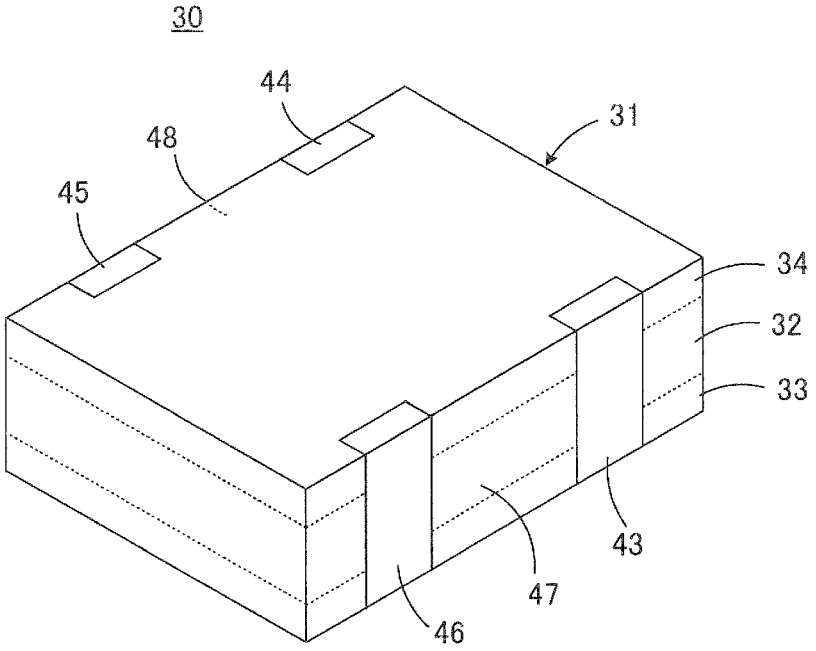
FIG. 1 is a perspective view illustrating the external appearance of a common mode choke coil according to a first embodiment of this disclosure.

As illustrated in FIG. 1, a common mode choke coil 30 includes a multilayer body 31 serving as a component main body. The multilayer body 31 has a structure in which a low magnetic permeability portion 32 is sandwiched between two magnetic body portions 33 and 34. The magnetic body portions 33 and 34 are constituted by a Ni—Cu—Zn-based ferrite, a Mn—Zn-based ferrite, a hexagonal ferrite, or the like, for example. On the other hand, a non-magnetic body such as a glass ceramic material having a magnetic permeability of almost 1, a Ni—Cu—Zn-based ferrite having a magnetic permeability of approximately 1 to 10, a non-magnetic ferrite, or the like can be used as the material of the low magnetic permeability portion 32, for example. A resin such as polyimide can also be used as the material of the low magnetic permeability portion 32.

First to fourth outer terminal electrodes 43 to 46 are provided on an outer surface of the multilayer body 31. More specifically, the outer terminal electrodes 43 and 46 are positioned on a side surface 47 of the multilayer body 31, and the outer terminal electrodes 44 and 45 are positioned on a side surface 48 opposite to the side surface 47. A conductive metal such as Cu, Pd, Al, Ag, or the like, or an alloy containing such metals, is used as a conductive material contained in the outer terminal electrodes 43 to 46.

Figure 2:
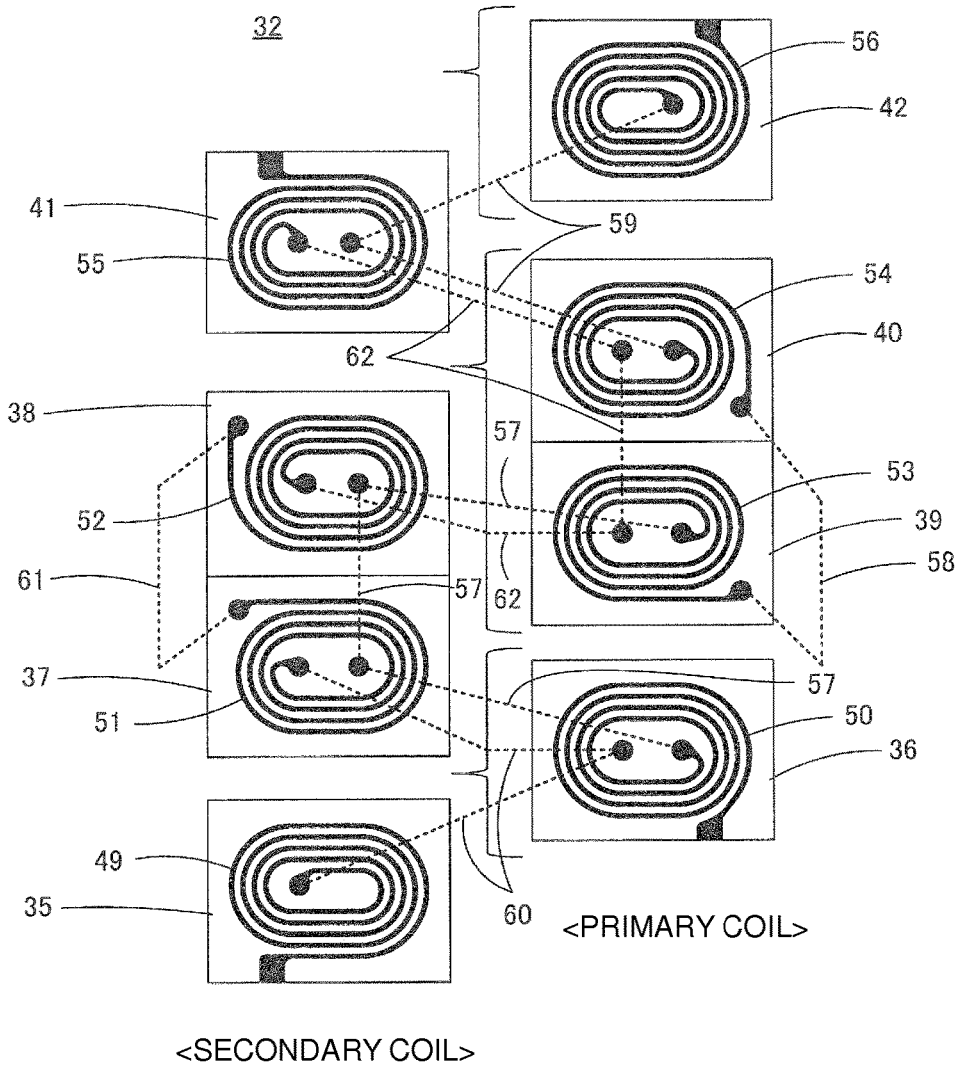
FIG. 2 is a plan view illustrating a plurality of insulation layers that constitute a low magnetic permeability portion in a multilayer body included in the common mode choke coil, the insulation layers being illustrated according to a lamination order thereof.

The low magnetic permeability portion 32 has a laminated structure provided with a plurality of laminated insulation layers including eight insulation layers 35 to 42 illustrated in FIG. 2. The insulation layers 35 to 42 are laminated in that order from the bottom. Note that the bracket signs indicated between the right column and the left column in FIG. 2 as well as FIGS. 5 and 6, which will be described later, indicate locations where the layers are inserted.

Spiral-shaped coil conductors 49 to 56 are formed on the insulation layers 35 to 42, respectively. Each of the coil conductors 49 to 56 has an inner circumferential side end portion located relatively near a central area of the corresponding insulation layers 35 to 42 and an outer circumferential side end portion located relatively near an outer edge of the corresponding insulation layers 35 to 42. It should be noted that although the coil conductors 49 to 56 are actually formed to extend along a boundary surface between the adjacent layers in the insulation layers 35 to 42, the following will describe the coil conductors 49 to 56 as being located on top of the corresponding insulation layers 35 to 42.

First and second coils are provided within the multilayer body 31, and more specifically, within the low magnetic permeability portion 32. Although the primary coil and the secondary coil are determined in a relative manner in the common mode choke coil 30, the following will describe the first and second coils as a primary coil and a secondary coil, respectively.

In FIG. 2, the primary coil is located on the right side, and the secondary coil is located on the left side. The first and second outer terminal electrodes 43 and 44 illustrated in FIG. 1 are each electrically connected to one end portion and another end portion of the primary coil, and likewise, the third and fourth outer terminal electrodes 45 and 46 illustrated in FIG. 1 are each electrically connected to one end portion and another end portion of the secondary coil. The primary coil is constituted of the coil conductors 50, 53, 54, and 56, and the secondary coil is constituted of the coil conductors 49, 51, 52, and 55.

First, a connection state of the coil conductors 50, 53, 54, and 56 that constitute the primary coil will be described.

To describe from the bottom of the lamination order, an outer circumferential side end portion of the coil conductor 50, which is formed on the insulation layer 36, is extended to an outer edge portion of the insulation layer 36, and is connected to the first outer terminal electrode 43 illustrated in FIG. 1. On the other hand, an inner circumferential side end portion of the coil conductor 50 is connected to an inner circumferential side via hole conductor 57 provided so as to pass through the insulation layers 37, 38, and 39.

Note that a via pad is formed in the via hole conductor 57 in the same manner as the via pad 3*a* formed associated with the via hole conductor 3 as described earlier with reference to FIG. 7. Although no particular descriptions will be given, the same applies to the other via hole conductors that will appear later on.

Next, the stated inner circumferential side via hole conductor 57 is connected to an inner circumferential side end portion of the coil conductor 53, which is formed on the insulation layer 39. In this manner, the inner circumferential side end portion of the coil conductor 50 and the inner circumferential side end portion of the coil conductor 53 are connected to each other by the inner circumferential side via hole conductor 57. An outer circumferential side end portion of the coil conductor 53 is connected to an outer circumferential side via hole conductor 58 provided so as to pass through the insulation layer 40.

Next, the stated outer circumferential side via hole conductor 58 is connected to an outer circumferential side end portion of the coil conductor 54, which is formed on the insulation layer 40. In this manner, the outer circumferential side end portion of the coil conductor 53 and the outer circumferential side end portion of the coil conductor 54 are connected to each other by the outer circumferential side via hole conductor 58. An inner circumferential side end portion of the coil conductor 54 is connected to an inner circumferential side via hole conductor 59 provided so as to pass through the insulation layers 41 and 42.

Next, the stated inner circumferential side via hole conductor 59 is connected to an inner circumferential side end portion of the coil conductor 56, which is formed on the insulation layer 42. In this manner, the inner circumferential side end portion of the coil conductor 54 and the inner circumferential side end portion of the coil conductor 56 are connected to each other by the inner circumferential side via hole conductor 59. An outer circumferential side end portion of the coil conductor 56 is extended to an outer edge portion of the insulation layer 42, and is connected to the second outer terminal electrode 44 illustrated in FIG. 1.

As described above, the primary coil is formed by connecting the coil conductors 50, 53, 54, and 56 through the inner circumferential side via hole conductor 57, the outer circumferential side via hole conductor 58, and the inner circumferential side via hole conductor 59 in succession, or in other words, through the inner circumferential side via hole conductors and the outer circumferential side via hole conductor in an alternating manner.

Next, a connection state of the coil conductors 49, 51, 52, and 55 that constitute the secondary coil will be described.

To describe from the bottom of the lamination order, an outer circumferential side end portion of the coil conductor 49, which is formed on the insulation layer 35, is extended to an outer edge portion of the insulation layer 35, and is connected to the fourth outer terminal electrode 46 illustrated in FIG. 1. On the other hand, an inner circumferential side end portion of the coil conductor 49 is connected to an inner circumferential side via hole conductor 60 provided so as to pass through the insulation layers 36 and 37.

Next, the stated inner circumferential side via hole conductor 60 is connected to an inner circumferential side end portion of the coil conductor 51, which is formed on the insulation layer 37. In this manner, the inner circumferential side end portion of the coil conductor 49 and the inner circumferential side end portion of the coil conductor 51 are connected to each other by the inner circumferential side via hole conductor 60. An outer circumferential side end portion of the coil conductor 51 is connected to an outer circumferential side via hole conductor 61 provided so as to pass through the insulation layer 38.

Next, the stated outer circumferential side via hole conductor 61 is connected to an outer circumferential side end portion of the coil conductor 52, which is formed on the insulation layer 38. In this manner, the outer circumferential side end portion of the coil conductor 51 and the outer circumferential side end portion of the coil conductor 52 are connected to each other by the outer circumferential side via hole conductor 61. An inner circumferential side end portion of the coil conductor 52 is connected to an inner circumferential side via hole conductor 62 provided so as to pass through the insulation layers 39, 40, and 41.

Next, the stated inner circumferential side via hole conductor 62 is connected to an inner circumferential side end portion of the coil conductor 55, which is formed on the insulation layer 41. In this manner, the inner circumferential side end portion of the coil conductor 52 and the inner circumferential side end portion of the coil conductor 55 are connected to each other by the inner circumferential side via hole conductor 62. An outer circumferential side end portion of the coil conductor 55 is extended to an outer edge portion of the insulation layer 41, and is connected to the third outer terminal electrode 45 illustrated in FIG. 1.

As described above, the secondary coil is formed by connecting the coil conductors 49, 51, 52, and 55 through the inner circumferential side via hole conductor 60, the outer circumferential side via hole conductor 61, and the inner circumferential side via hole conductor 62 in succession, or in other words, through the inner circumferential side via hole conductors and the outer circumferential side via hole conductor in an alternating manner.

A conductive metal such as Cu, Pd, Al, Ag, or the like, or an alloy containing such metals, is used as a conductive material contained in the stated coil conductors 49 to 56 and the via hole conductors 57 to 62.

In the common mode choke coil 30 described thus far, the outer circumferential side via hole conductors 58 and 61 are both provided so as to only pass through the one insulation layer 40 or the one insulation layer 38. Accordingly, problems caused by the outer circumferential side via hole conductors 58 and 61 can be made less likely to occur, as will be described below with reference to FIG. 3.

Figure 3:
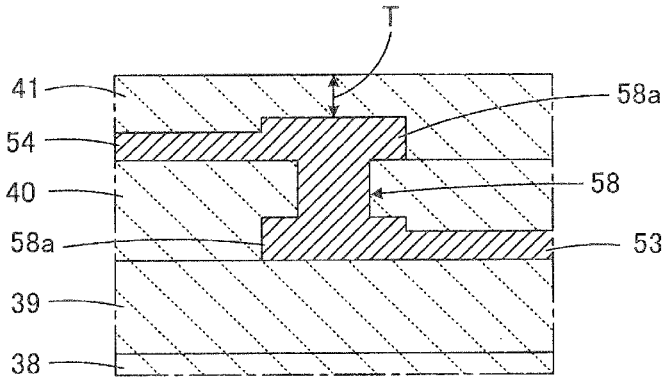
FIG. 3 is a cross-sectional view illustrating an outer circumferential side via hole conductor and the vicinity thereof in the multilayer body included in the common mode choke coil, in an enlarged manner.

FIG. 3 illustrates the outer circumferential side via hole conductor 58 and the vicinity thereof, as a representative example of the outer circumferential side via hole conductors 58 and 61. In FIG. 3, elements that correspond to the elements illustrated in FIG. 2 are given the same reference numerals. A via pad **58*a* is formed at a boundary surface position between the insulation layers 39 to 41 so as to extend outward around the outer circumferential side via hole conductor 58**.

During the manufacture of the common mode choke coil 30, when the multilayer body 31 is pressed in a pressing process carried out prior to firing, the conductive material that is used for the via hole conductors 57 to 62 has a property of being less susceptible to compression deformation by the pressing than the insulation material that is used for the insulation layers 35 to 42. As such, a thickness T of the insulation layer 41, for example, tends to drop due to the insulation layer 41 being compressed at the areas where the via hole conductor 58 and the via pad **58*a* are located. However, the via hole conductor 58 only passes through the one insulation layer 40, and thus the length thereof in the axis line direction is shorter than in the case of the via hole conductor 3 illustrated in FIG. 7. As a result, the thickness T of the insulation layer 41** does not drop very much.

Figure 7:
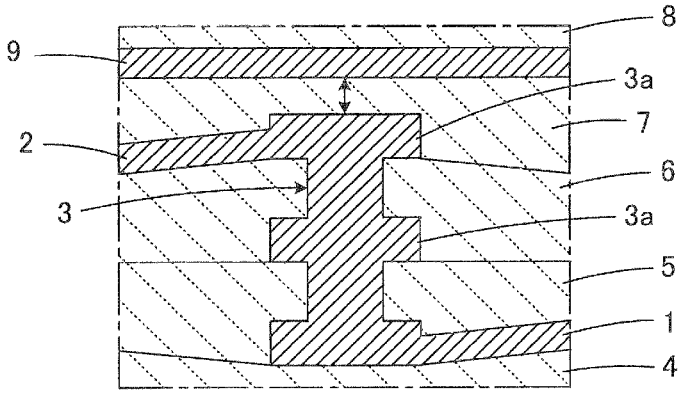
FIG. 7 is a diagram, corresponding to FIG. 3, for illustrating a problem to be solved by this disclosure, and illustrates, in an enlarged manner, a part of a multilayer body included in a common mode choke coil that employs an alternating laminated structure.
Figure 8:
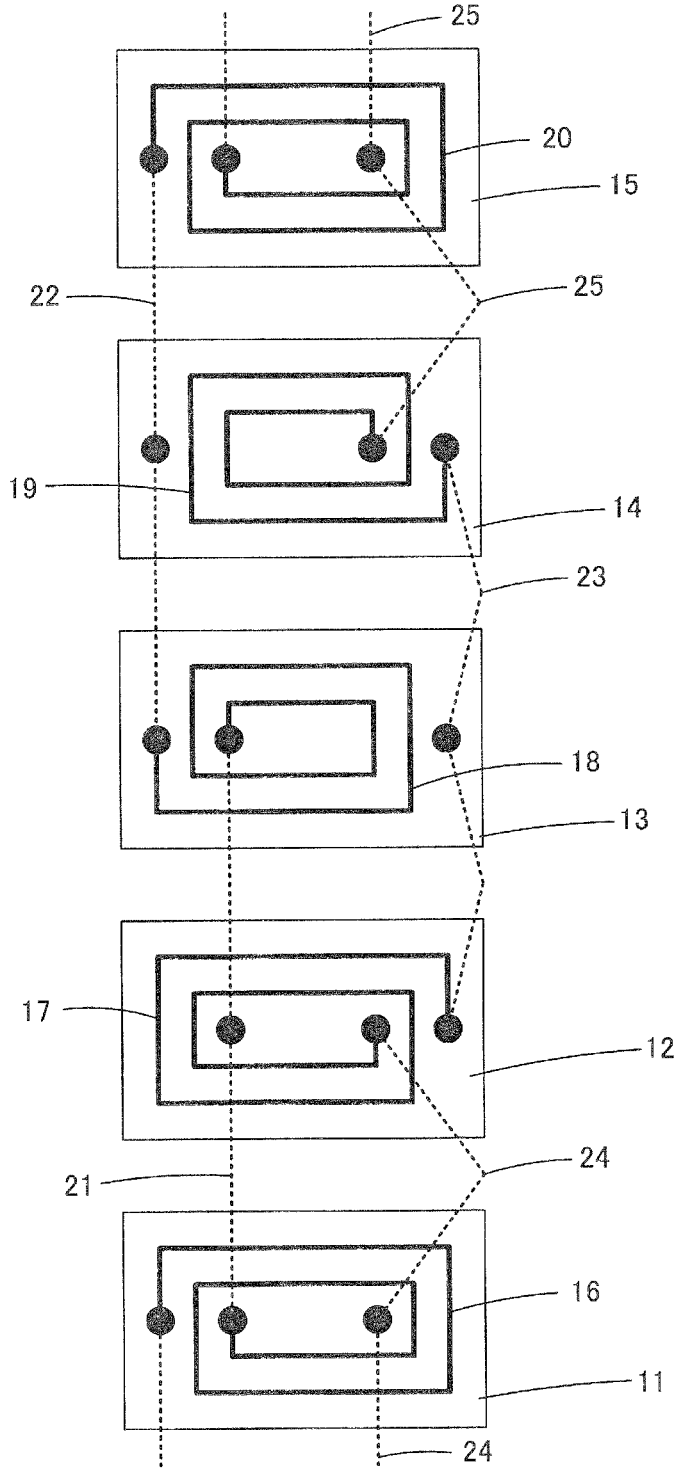
FIG. 8 is a plan view illustrating a plurality of insulation layers that constitute a multilayer body included in a common mode choke coil employing an alternating laminated structure, the insulation layers being disposed according to a lamination order thereof.
Figure 9:
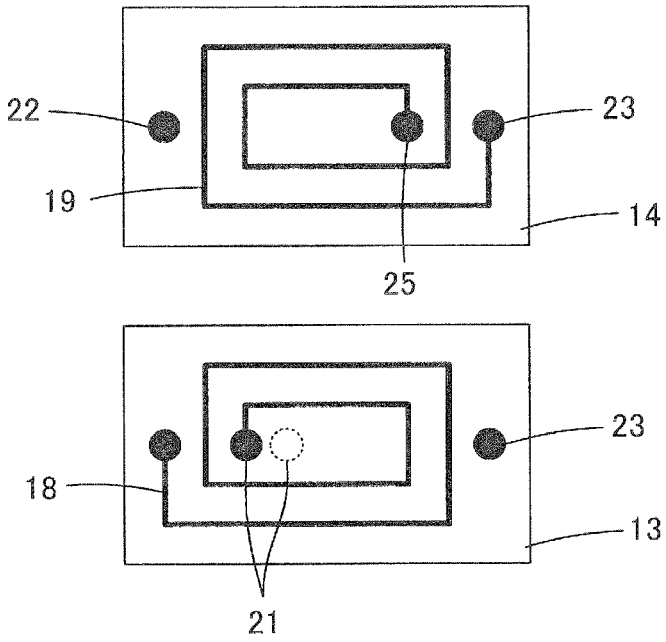
FIG. 9 is a plan view illustrating a problem to be solved by this disclosure, and illustrates the insulation layers shown in FIG. 8.
Figure 10:
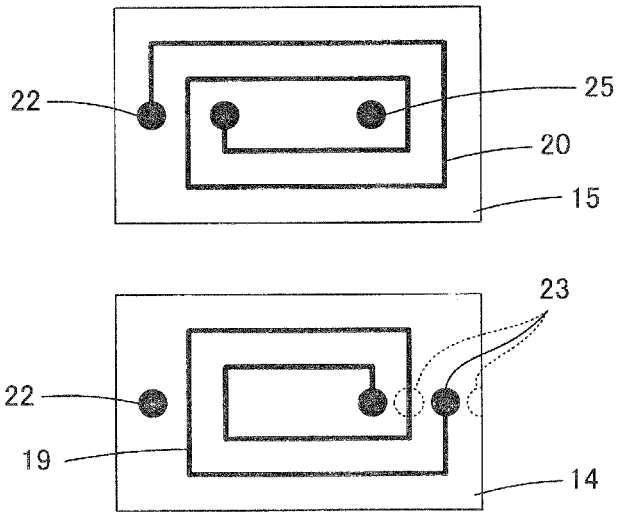
FIG. 10 is a plan view illustrating a problem to be solved by this disclosure, and illustrates the insulation layers shown in FIG. 8.

Furthermore, the outer circumferential side via hole conductors 58 and 61 have a smaller amount of conductive material than in the case of the via hole conductor 3 illustrated in FIG. 7, and thus the amount of the conductive material diffused into the insulation layers 35 to 42 during the firing process can be reduced.

Based on this, there is less concern of a drop in breakdown voltage reliability even if a conductor that can generate a potential difference is disposed between the outer circumferential side via hole conductors 58 and 61 on a line extending from the axis lines of the outer circumferential side via hole conductors 58 and 61 or in the vicinity thereof.

Figure 5:
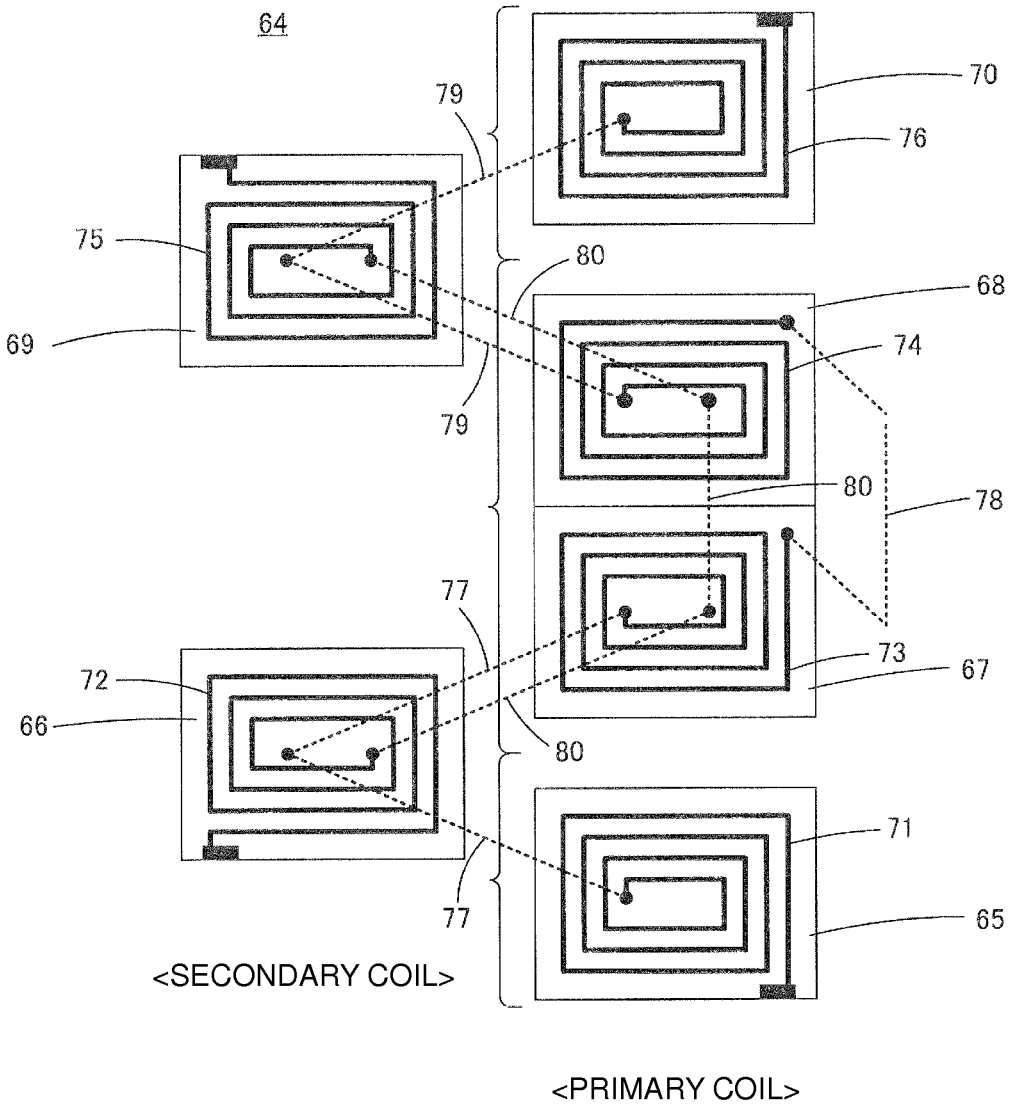
FIG. 5 is a diagram illustrating a second embodiment of this disclosure, and corresponds to FIG. 2.
Figure 6:
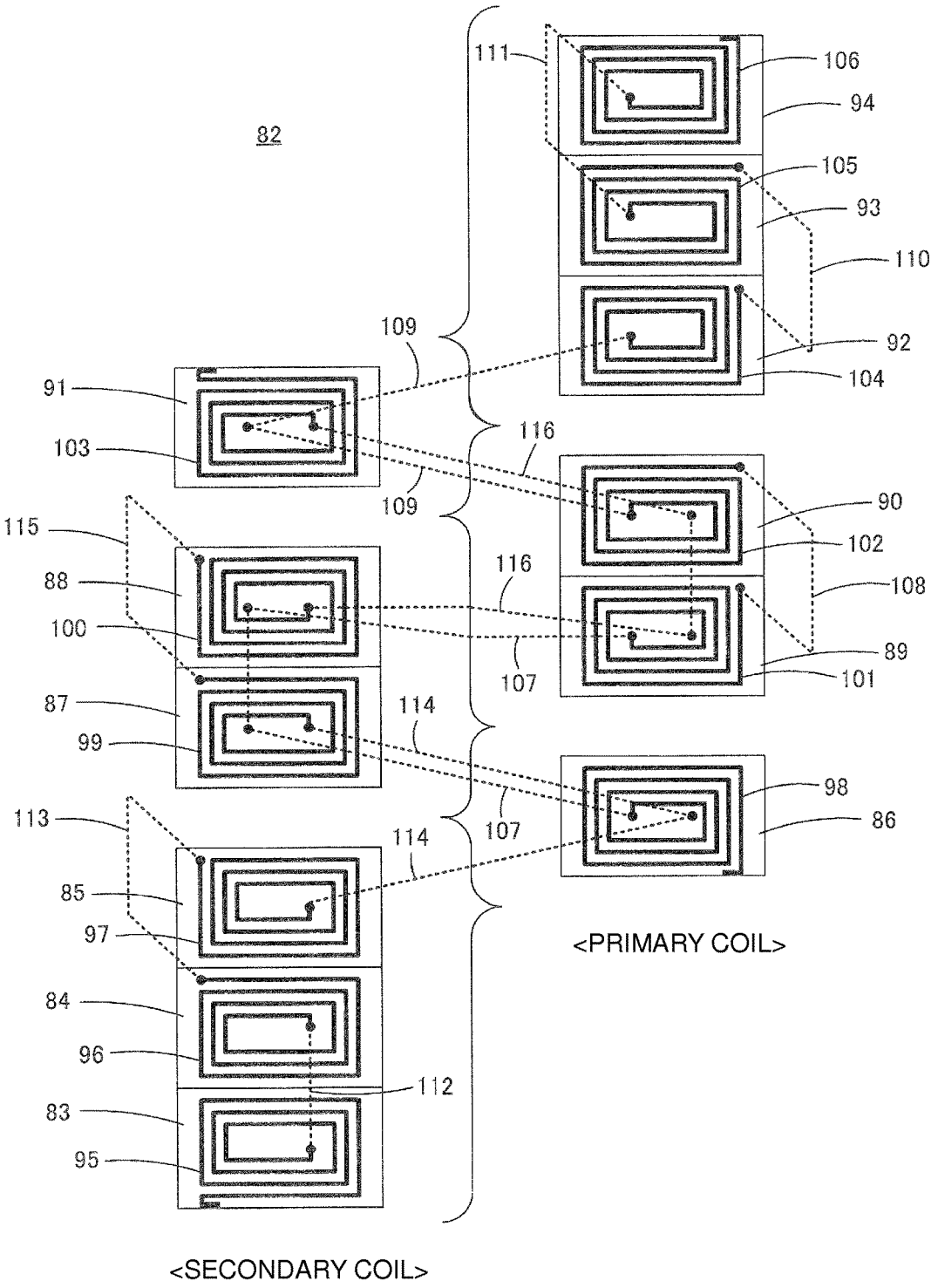
FIG. 6 is a diagram illustrating a third embodiment of this disclosure, and corresponds to FIG. 2.

Accordingly, the degree of freedom with which the coil shapes can be designed in the common mode choke coil 30 can be increased. With the coil shapes illustrated in FIG. 2, for example, the coil conductors 52 and 55 for the secondary coil will not be located on a line extending from the axis line of the outer circumferential side via hole conductor 58 for the primary coil, and conversely, the coil conductors 50 and 53 for the primary coil will not be located on a line extending from the axis line of the outer circumferential side via hole conductor 61 for the secondary coil. However, in order to increase the number of turns in the coil, design changes such as extending the coil conductor further in the outward direction, changing the manner in which the coil conductor extends from an elliptical shape as illustrated in FIG. 2 to a rectangular shape as illustrated in FIGS. 5 and 6, which will be described later, and so on can be carried out without problems.

Meanwhile, with the coil shape illustrated in FIG. 2, the outer circumferential side via hole conductor 58 and the outer terminal electrodes 45 and 46 that can generate a potential difference therebetween are relatively distanced from each other, but a design change that brings the outer circumferential side via hole conductor 58 and the outer terminal electrodes 45 and 46 closer to each other is also permissible. The same applies to the relationship between the outer circumferential side via hole conductor 61 and the outer terminal electrodes 43 and 44.

Meanwhile, in the common mode choke coil 30, the coil conductor for the secondary coil includes such a coil conductor that is laminated so as to be interposed between two coil conductors, of the coil conductors for the primary coil, that are connected to each other by an inner circumferential side via hole conductor. To be more specific, the coil conductors 51 and 52 for the secondary coil are laminated so as to be interposed between the coil conductors 50 and 53 for the primary coil that are connected to each other by the inner circumferential side via hole conductor 57, and the coil conductor 55 for the secondary coil is laminated so as to be interposed between the coil conductors 54 and 56 for the primary coil that are connected to each other by the inner circumferential side via hole conductor 59.

Conversely, the coil conductor for the primary coil also includes such a coil conductor that is laminated so as to be interposed between two coil conductors, of the coil conductors for the secondary coil, that are connected to each other by an inner circumferential side via hole conductor. To be more specific, the coil conductor 50 for the primary coil is laminated so as to be interposed between the coil conductors 49 and 51 for the secondary coil that are connected to each other by the inner circumferential side via hole conductor 60, and the coil conductors 53 and 54 for the primary coil are laminated so as to be interposed between the coil conductors 52 and 55 for the secondary coil that are connected to each other by the inner circumferential side via hole conductor 62.

As a result of this configuration, in five pairs of coil conductors, namely the coil conductor 49 and the coil conductor 50, the coil conductor 50 and the coil conductor 51, the coil conductor 52 and the coil conductor 53, the coil conductor 54 and the coil conductor 55, and the coil conductor 55 and the coil conductor 56, the coil conductors for the primary coil and the coil conductors for the secondary coil can be positioned so as to sandwich only one insulation layer. As such, a strong coupling can be achieved between the primary coil and the secondary coil.

As illustrated in FIG. 2, in the common mode choke coil 30, the form of the primary coil and the form of the secondary coil are symmetrical relative to the lamination direction. This means that there is no directivity when mounting the common mode choke coil 30. Accordingly, when mounting the common mode choke coil 30, the positions of the first and second outer terminal electrodes 43 and 44 and the positions of the third and fourth outer terminal electrodes 45 and 46 can be inverted relative to each other.

A characteristic impedance $Z_0$ of the common mode choke coil is known to be expressed as follows, in the case where there is no loss in the transmission line:

$$Z_0=(L/C)^{1/2}$$

Here, L represents serial inductance and C represents parallel electrostatic capacity. The parallel electrostatic capacity C is generated with the dielectric property of the insulation layer located between coil conductors, and the insulation layers 35 to 42 that constitute the low magnetic permeability portion 32 normally have a relative permittivity of approximately 2 to 6.

From the above formula, it can be seen that the characteristic impedance $Z_0$ can be adjusted by changing the parallel electrostatic capacity C. Based on the characteristic configuration of the common mode choke coil 30 according to this embodiment, the parallel electrostatic capacity C can be changed with ease, and thus the characteristic impedance $Z_0$ can be adjusted with ease as a result, as will be described below.

Figure 4:
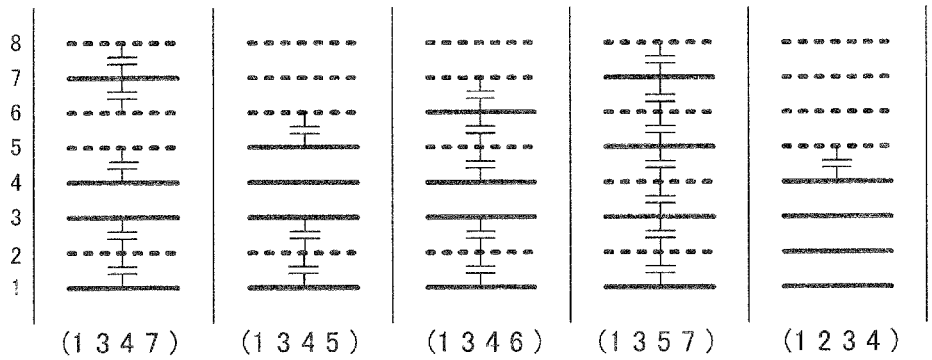
FIG. 4 is a diagram illustrating adjusting a characteristic impedance by making various changes to the lamination order of coil conductors for a primary coil and coil conductors for a secondary coil in a common mode choke coil including a laminated-type coil.

FIG. 4 schematically illustrates five examples in which, in a common mode choke coil including a laminated-type coil, the lamination order of coil conductors for a primary coil and coil conductors for a secondary coil is changed.

In FIG. 4, the horizontal dotted lines indicate the coil conductors for the primary coil, and the horizontal solid lines indicate the coil conductors for the secondary coil. Meanwhile, the numbers "1" to "8" written on the left end indicate lamination positions from the bottom. An indication such as "(1347)" written below each of the five examples in which the lamination order has been varied indicates the lamination positions at which the coil conductors for the secondary coil indicated by the solid lines are located; for example, "(1347)" in the leftmost column indicates that, corresponding to the numbers "1" to "8" written on the left end, coil conductors for the secondary coil are located at the respective lamination positions of "1", "3", "4", and "7".

Meanwhile, an electrostatic capacity that contributes to the aforementioned parallel electrostatic capacity C is generated at a location where a coil conductor for the primary coil and a coil conductor for the secondary coil oppose each other. In FIG. 4, the locations where such electrostatic capacity is generated are indicated by signs representing capacitors.

The common mode choke coil 30 described with reference to FIG. 2 has the lamination order of "(1347)" in the leftmost column. In this case, the electrostatic capacity is generated at five locations.

As can be seen from the aforementioned example, the number of locations where the electrostatic capacity is generated can be changed by changing the lamination order of the coil conductors for the primary coil and the coil conductors for the secondary coil.

With the lamination order of "(1345)", the electrostatic capacity is generated at three locations. Accordingly, the parallel electrostatic capacity C for the lamination order of "(1345)" is lower than that of the lamination order of "(1347)", and thus the characteristic impedance $Z_0$ becomes greater.

With the lamination order of "(1346)", the electrostatic capacity is generated at five locations, in the same manner as the lamination order of "(1347)". Accordingly, these parallel electrostatic capacities C can be thought of as being the same as each other. Note that in actuality, the parallel electrostatic capacities C are not normally exactly the same, due to subtle differences in the coil conductor patterns.

With the lamination order of "(1357)", the structure corresponds to the alternating laminated structure disclosed in Japanese Unexamined Patent Application Publication No. 2001-44033, and thus the electrostatic capacity is generated at seven locations. Accordingly, the lamination order of "(1357)" has a greater parallel electrostatic capacity C than the lamination order of "(1347)" and the lamination order of "(1346)", and thus the characteristic impedance $Z_0$ becomes lower.

The lamination order of "(1234)" corresponds to the lamination structure in which the primary coil and the secondary coil are separated from each other as disclosed in Japanese Unexamined Patent Application Publication No. 2003-68528, and thus the electrostatic capacity is generated at only one location. Accordingly, the lamination order of "(1234)" has a lower parallel electrostatic capacity C than any of the lamination orders mentioned above, and as a result, the characteristic impedance $Z_0$ becomes greater.

In FIG. 4, the lamination orders of "(1347)", "(1345)", and "(1346)" fall within the scope of this disclosure.

Of the examples that fall within the scope of this disclosure, for "(1347)", there is a location where two coil conductors for the same coil are arranged in the lamination direction, in both the primary coil and the secondary coil; the two coil conductors arranged in this manner are connected to each other by an outer circumferential side via hole conductor.

Next, with respect to "(1345)", coil conductors for the primary coil are located at the lamination positions "2" and "6" to "8", and coil conductors for the secondary coil are located at the lamination positions "1" and "3" to "5". In the primary coil, the coil conductors at the lamination positions "2" and "6" to "8" are connected in series through an inner circumferential side via hole conductor and an outer circumferential side via hole conductor in an alternating manner, and thus the coil conductor at the lamination position "6" and the coil conductor at the lamination position "7" are connected to each other by an outer circumferential side via hole conductor that passes through only one insulation layer. On the other hand, in the secondary coil, the coil conductors at the lamination positions "1" and "3" to "5" are connected in series through an inner circumferential side via hole conductor and an outer circumferential side via hole conductor in an alternating manner, and thus the coil conductor at the lamination position "3" and the coil conductor at the lamination position "4" are connected to each other by an outer circumferential side via hole conductor that passes through only one insulation layer.

Next, with respect to "(1346)", coil conductors for the primary coil are located at the lamination positions "2", "5", "7", and "8", and coil conductors for the secondary coil are located at the lamination positions "1", "3", "4", and "6". In the primary coil, the coil conductors at the lamination positions "2", "5", "7", and "8" are connected in series through an inner circumferential side via hole conductor and an outer circumferential side via hole conductor in an alternating manner, and thus the coil conductor at the lamination position "5" and the coil conductor at the lamination position "7" are connected to each other by an outer circumferential side via hole conductor. However, the outer circumferential side via hole conductor that connects the coil conductor at the lamination position "5" and the coil conductor at the lamination position "7" to each other passes through two insulation layers interposing the coil conductor for the secondary coil. On the other hand, in the secondary coil, the coil conductors at the lamination positions "1", "3", "4", and "6" are connected in series through an inner circumferential side via hole conductor and an outer circumferential side via hole conductor in an alternating manner, and thus the coil conductor at the lamination position "3" and the coil conductor at the lamination position "4" are connected to each other by an outer circumferential side via hole conductor that passes through only one insulation layer. Accordingly, in the example of "(1346)", only the secondary coil meets the condition of an outer circumferential side via hole conductor being provided so as to pass through only one insulation layer.

From these three examples, it can be seen that changing the lamination order makes it possible to adjust the characteristic impedance $Z_0$. Such adjustment of the characteristic impedance $Z_0$ is advantageous in that it is unnecessary to increase the opposing distance between coil conductors that can worsen the common mode impedance gain efficiency, reduce the opposing distance between coil conductors that can cause insulation resistance degradation, and so on.

Although the first embodiment illustrated in FIG. 2 includes the coil conductors 49 to 56 distributed across eight layers, the number of coil conductors that are laminated can be changed in various ways within the scope of this disclosure. A representative example of an embodiment in which the number of coil conductors that are laminated is changed will be described next.

In a second embodiment of this disclosure, illustrated in FIG. 5, the number of coil conductors that are laminated is six. Although the shape in which the coil conductors extend is elliptical in FIG. 2, the shape in which the coil conductors extend is rectangular in FIG. 5 and FIG. 6 to be explained later, but this is not an essential difference.

The common mode choke coil described with reference to FIG. 5 has a similar external appearance as the common mode choke coil 30 illustrated in FIG. 1. As illustrated in FIG. 5, a low magnetic permeability portion 64 included in the multilayer body of this common mode choke coil has a laminated structure provided with a plurality of insulation layers including six insulation layers 65 to 70. The insulation layers 65 to 70 are laminated in that order from the bottom. Spiral-shaped coil conductors 71 to 76 are formed on the insulation layers 65 to 70, respectively.

In FIG. 5, the primary coil is located on the right side, and the secondary coil is located on the left side. The primary coil is constituted by the coil conductors 71, 73, 74, and 76, and the secondary coil is constituted by the coil conductors 72 and 75.

First, a connection state of the coil conductors 71, 73, 74, and 76 that constitute the primary coil will be described. Note that the connection state of the primary coil is substantially the same as the connection state of the primary coil illustrated in FIG. 2.

To describe from the bottom of the lamination order, an outer circumferential side end portion of the coil conductor 71, which is formed on the insulation layer 65, is extended to an outer edge portion of the insulation layer 65, and is connected to an outer terminal electrode corresponding to the first outer terminal electrode 43 illustrated in FIG. 1. On the other hand, an inner circumferential side end portion of the coil conductor 71 is connected to an inner circumferential side via hole conductor 77 provided so as to pass through the insulation layers 66 and 67.

Next, the stated inner circumferential side via hole conductor 77 is connected to an inner circumferential side end portion of the coil conductor 73, which is formed on the insulation layer 67. In this manner, the inner circumferential side end portion of the coil conductor 71 and the inner circumferential side end portion of the coil conductor 73 are connected to each other by the inner circumferential side via hole conductor 77. An outer circumferential side end portion of the coil conductor 73 is connected to an outer circumferential side via hole conductor 78 provided so as to pass through the insulation layer 68.

Next, the stated outer circumferential side via hole conductor 78 is connected to an outer circumferential side end portion of the coil conductor 74, which is formed on the insulation layer 68. In this manner, the outer circumferential side end portion of the coil conductor 73 and the outer circumferential side end portion of the coil conductor 74 are connected to each other by the outer circumferential side via hole conductor 78. An inner circumferential side end portion of the coil conductor 74 is connected to an inner circumferential side via hole conductor 79 provided so as to pass through the insulation layers 69 and 70.

Next, the stated inner circumferential side via hole conductor 79 is connected to an inner circumferential side end portion of the coil conductor 76, which is formed on the insulation layer 70. In this manner, the inner circumferential side end portion of the coil conductor 74 and the inner circumferential side end portion of the coil conductor 76 are connected to each other by the inner circumferential side via hole conductor 79. An outer circumferential side end portion of the coil conductor 76 is extended to an outer edge portion of the insulation layer 70, and is connected to an outer terminal electrode that corresponds to the second outer terminal electrode 44 illustrated in FIG. 1.

As described above, the primary coil is formed by connecting the coil conductors 71, 73, 74, and 76 through the inner circumferential side via hole conductor 77, the outer circumferential side via hole conductor 78, and the inner circumferential side via hole conductor 79 in succession, or in other words, through the inner circumferential side via hole conductors and the outer circumferential side via hole conductor in an alternating manner.

Next, a connection state of the coil conductors 72 and 75 that constitute the secondary coil will be described.

To describe from the bottom of the lamination order, an outer circumferential side end portion of the coil conductor 72, which is formed on the insulation layer 66, is extended to an outer edge portion of the insulation layer 66, and is connected to an outer terminal electrode corresponding to the fourth outer terminal electrode 46 illustrated in FIG. 1. On the other hand, an inner circumferential side end portion of the coil conductor 72 is connected to an inner circumferential side via hole conductor 80 provided so as to pass through the insulation layers 67, 68, and 69.

Next, the stated inner circumferential side via hole conductor 80 is connected to an inner circumferential side end portion of the coil conductor 75, which is formed on the insulation layer 69. In this manner, the inner circumferential side end portion of the coil conductor 72 and the inner circumferential side end portion of the coil conductor 75 are connected to each other by the inner circumferential side via hole conductor 80. An outer circumferential side end portion of the coil conductor 75 is extended to an outer edge portion of the insulation layer 69, and is connected to an outer terminal electrode that corresponds to the third outer terminal electrode 45 illustrated in FIG. 1.

As described above, the secondary coil is formed by connecting the coil conductors 72 and 75 through the inner circumferential side via hole conductor 80.

Even in the embodiment described above, the outer circumferential side via hole conductor 78 is provided so as to pass through only the one insulation layer 68. Accordingly, in the same manner as in the embodiment described earlier, problems caused by the outer circumferential side via hole conductor 78 can be made less likely to occur.

In particular, in the embodiment illustrated in FIG. 5, the coil conductors 72 and 75 for the secondary coil are located on a line extending from the axis line of the outer circumferential side via hole conductor 78 for the primary coil, but the breakdown voltage reliability between the outer circumferential side via hole conductor 78 and the coil conductors 72 and 75, between which a potential difference can be generated, is ensured.

Meanwhile, in the embodiment illustrated in FIG. 5, in four pairs of coil conductors, namely the coil conductor 71 and the coil conductor 72, the coil conductor 72 and the coil conductor 73, the coil conductor 74 and the coil conductor 75, and the coil conductor 75 and the coil conductor 76, the coil conductors for the primary coil and the coil conductors for the secondary coil can be positioned so as to sandwich only one insulation layer. As such, a strong coupling can be achieved between the primary coil and the secondary coil.

In addition, as illustrated in FIG. 5, also according to this embodiment, a common mode choke coil in which the form of the primary coil and the form of the secondary coil are symmetrical relative to the lamination direction can be realized.

Note that points not particularly mentioned in the second embodiment are to be understood as being substantially the same as those in the first embodiment.

Next, in a third embodiment of this disclosure, illustrated in FIG. 6, the number of coil conductors that are laminated is twelve.

The common mode choke coil described with reference to FIG. 6 also has a similar external appearance as the common mode choke coil 30 illustrated in FIG. 1. As illustrated in FIG. 6, a low magnetic permeability portion 82 included in the multilayer body of this common mode choke coil has a laminated structure provided with a plurality of insulation layers including twelve insulation layers 83 to 94. The insulation layers 83 to 94 are laminated in that order from the bottom. Spiral-shaped coil conductors 95 to 106 are formed on the insulation layers 83 to 94, respectively.

In FIG. 6, the primary coil is located on the right side, and the secondary coil is located on the left side. The primary coil is constituted of the coil conductors 98, 101, 102, 104, 105, and 106, and the secondary coil is constituted of the coil conductors 95, 96, 97, 99, 100, and 103.

First, a connection state of the coil conductors 98, 101, 102, 104, 105, and 106 that constitute the primary coil will be described. Note that the connection state of the coil conductors 98, 101, 102, and 104 of the primary coil is substantially the same as the connection state of the primary coil illustrated in FIG. 2.

To describe from the bottom of the lamination order, an outer circumferential side end portion of the coil conductor 98, which is formed on the insulation layer 86, is extended to an outer edge portion of the insulation layer 86, and is connected to an outer terminal electrode corresponding to the first outer terminal electrode 43 illustrated in FIG. 1. On the other hand, an inner circumferential side end portion of the coil conductor 98 is connected to an inner circumferential side via hole conductor 107 provided so as to pass through the insulation layers 87, 88, and 89.

Next, the stated inner circumferential side via hole conductor 107 is connected to an inner circumferential side end portion of the coil conductor 101, which is formed on the insulation layer 89. In this manner, the inner circumferential side end portion of the coil conductor 98 and the inner circumferential side end portion of the coil conductor 101 are connected to each other by the inner circumferential side via hole conductor 107. An outer circumferential side end portion of the coil conductor 101 is connected to an outer circumferential side via hole conductor 108 provided so as to pass through the insulation layer 90.

Next, the stated outer circumferential side via hole conductor 108 is connected to an outer circumferential side end portion of the coil conductor 102, which is formed on the insulation layer 90. In this manner, the outer circumferential side end portion of the coil conductor 101 and the outer circumferential side end portion of the coil conductor 102 are connected to each other by the outer circumferential side via hole conductor 108. An inner circumferential side end portion of the coil conductor 102 is connected to an inner circumferential side via hole conductor 109 provided so as to pass through the insulation layers 91 and 92.

Next, the stated inner circumferential side via hole conductor 109 is connected to an inner circumferential side end portion of the coil conductor 104, which is formed on the insulation layer 92. In this manner, the inner circumferential side end portion of the coil conductor 102 and the inner circumferential side end portion of the coil conductor 104 are connected to each other by the inner circumferential side via hole conductor 109. An outer circumferential side end portion of the coil conductor 104 is connected to an outer circumferential side via hole conductor 110 provided on the insulation layer 93.

Next, the stated outer circumferential side via hole conductor 110 is connected to an outer circumferential side end portion of the coil conductor 105, which is formed on the insulation layer 93. In this manner, the outer circumferential side end portion of the coil conductor 104 and the outer circumferential side end portion of the coil conductor 105 are connected to each other by the outer circumferential side via hole conductor 110. An inner circumferential side end portion of the coil conductor 105 is connected to an inner circumferential side via hole conductor 111 provided so as to pass through the insulation layer 94.

Next, the stated inner circumferential side via hole conductor 111 is connected to an inner circumferential side end portion of the coil conductor 106, which is formed on the insulation layer 94. In this manner, the inner circumferential side end portion of the coil conductor 105 and the inner circumferential side end portion of the coil conductor 106 are connected to each other by the inner circumferential side via hole conductor 111. An outer circumferential side end portion of the coil conductor 106 is extended to an outer edge portion of the insulation layer 94, and is connected to an outer terminal electrode that corresponds to the second outer terminal electrode 44 illustrated in FIG. 1.

As described above, the primary coil is formed by connecting the coil conductors 98, 101, 102, 104, 105, and 106 through the inner circumferential side via hole conductor 107, the outer circumferential side via hole conductor 108, the inner circumferential side via hole conductor 109, the outer circumferential side via hole conductor 110, and the inner circumferential side via hole conductor 111 in succession, or in other words, through the inner circumferential side via hole conductors and the outer circumferential side via hole conductors in an alternating manner.

Next, a connection state of the coil conductors 95, 96, 97, 99, 100, and 103 that constitute the secondary coil will be described. Note that the connection state of the coil conductors 97, 99, 100, and 103 of the secondary coil is substantially the same as the connection state of the secondary coil illustrated in FIG. 2.

To describe from the bottom of the lamination order, an outer circumferential side end portion of the coil conductor 95, which is formed on the insulation layer 83, is extended to an outer edge portion of the insulation layer 83, and is connected to an outer terminal electrode corresponding to the fourth outer terminal electrode 46 illustrated in FIG. 1. An inner circumferential side end portion of the coil conductor 95 is connected to an inner circumferential side via hole conductor 112 provided so as to pass through the insulation layer 84.

Next, the stated inner circumferential side via hole conductor 112 is connected to an inner circumferential side end portion of the coil conductor 96, which is formed on the insulation layer 84. In this manner, the inner circumferential side end portion of the coil conductor 95 and the inner circumferential side end portion of the coil conductor 96 are connected to each other by the inner circumferential side via hole conductor 112. An outer circumferential side end portion of the coil conductor 96 is connected to an outer circumferential side via hole conductor 113 provided so as to pass through the insulation layer 85.

Next, the stated outer circumferential side via hole conductor 113 is connected to an outer circumferential side end portion of the coil conductor 97, which is formed on the insulation layer 85. In this manner, the outer circumferential side end portion of the coil conductor 96 and the outer circumferential side end portion of the coil conductor 97 are connected to each other by the outer circumferential side via hole conductor 113. An inner circumferential side end portion of the coil conductor 97 is connected to an inner circumferential side via hole conductor 114 provided so as to pass through the insulation layers 86 and 87.

Next, the stated inner circumferential side via hole conductor 114 is connected to an inner circumferential side end portion of the coil conductor 99, which is formed on the insulation layer 87. In this manner, the inner circumferential side end portion of the coil conductor 97 and the inner circumferential side end portion of the coil conductor 99 are connected to each other by the inner circumferential side via hole conductor 114. An outer circumferential side end portion of the coil conductor 99 is connected to an outer circumferential side via hole conductor 115 provided on the insulation layer 88.

Next, the stated outer circumferential side via hole conductor 115 is connected to an outer circumferential side end portion of the coil conductor 100, which is formed on the insulation layer 88. In this manner, the outer circumferential side end portion of the coil conductor 99 and the outer circumferential side end portion of the coil conductor 100 are connected to each other by the outer circumferential side via hole conductor 115. An inner circumferential side end portion of the coil conductor 100 is connected to an inner circumferential side via hole conductor 116 provided so as to pass through the insulation layers 89, 90, and 91.

Next, the stated inner circumferential side via hole conductor 116 is connected to an inner circumferential side end portion of the coil conductor 103, which is formed on the insulation layer 91. In this manner, the inner circumferential side end portion of the coil conductor 100 and the inner circumferential side end portion of the coil conductor 103 are connected to each other by the inner circumferential side via hole conductor 116. An outer circumferential side end portion of the coil conductor 103 is extended to an outer edge portion of the insulation layer 91, and is connected to an outer terminal electrode that corresponds to the third outer terminal electrode 45 illustrated in FIG. 1.

As described above, the secondary coil is formed by connecting the coil conductors 95, 96, 97, 99, 100, and 103 through the inner circumferential side via hole conductor 112, the outer circumferential side via hole conductor 113, the inner circumferential side via hole conductor 114, the outer circumferential side via hole conductor 115, and the inner circumferential side via hole conductor 116 in succession, or in other words, through the inner circumferential side via hole conductors and the outer circumferential side via hole conductors in an alternating manner.

Also in the third embodiment described above, the outer circumferential side via hole conductors 108, 110, 113, and 115 are each provided so as to pass through only one insulation layer 90, 93, 85, or 88, respectively. Accordingly, in the same manner as in the embodiments described earlier, problems caused by the outer circumferential side via hole conductor 108, 110, 113, and 115 can be made less likely to occur.

In particular, in the embodiment illustrated in FIG. 6, in the same manner as the embodiment illustrated in FIG. 5, the coil conductors 100 and 103 for the secondary coil are located on a line extending from the respective axis lines of the outer circumferential side via hole conductors 108 and 110 for the primary coil, and the coil conductors 98 and 101 for the primary coil are located on a line extending from the respective axis lines of the outer circumferential side via hole conductors 113 and 115 for the secondary coil. However, the breakdown voltage reliability between the outer circumferential side via hole conductors 108 and 110 and the coil conductors 100 and 103, and between the outer circumferential side via hole conductors 113 and 115 and the coil conductors 98 and 101, between which potential differences can be generated, is ensured.

Meanwhile, in the embodiment illustrated in FIG. 6, in five pairs of coil conductors, namely the coil conductor 97 and the coil conductor 98, the coil conductor 98 and the coil conductor 99, the coil conductor 100 and the coil conductor 101, the coil conductor 102 and the coil conductor 103, and the coil conductor 103 and the coil conductor 104, the coil conductors for the primary coil and the coil conductors for the secondary coil can be positioned so as to sandwich only one insulation layer. As such, a strong coupling can be achieved between the primary coil and the secondary coil.

In addition, as illustrated in FIG. 6, also according to this embodiment, a common mode choke coil in which the form of the primary coil and the form of the secondary coil are symmetrical relative to the lamination direction can be realized.

Note that points not particularly mentioned in the third embodiment are to be understood as being substantially the same as those in the first embodiment as well.

While this disclosure has been described thus far with reference to several embodiments illustrated in the drawings, it should be noted that many variations can be made thereon without departing from the scope of the disclosure.

For example, the number of coil conductors that are laminated can be increased or decreased based on the design.

Furthermore, the positional relationship between the inner circumferential side via hole conductor and the outer circumferential side via hole conductor in a single insulation layer, the positional relationship between the outer terminal electrode and the inner circumferential side via hole conductor and outer circumferential side via hole conductor, and so on may be adopted with another positional relationship other than those illustrated.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil comprising:

a multilayer body having a laminated structure provided with a plurality of laminated insulation layers;

first and second coils provided within the multilayer body; and first to fourth outer terminal electrodes provided on an outer surface of the multilayer body, wherein the first and second outer terminal electrodes are electrically connected to one end and another end, respectively, of the first coil;

the third and fourth outer terminal electrodes are electrically connected to one end and another end, respectively, of the second coil;

the first and second coils each include a plurality of spiral-shaped coil conductors that extend along a plurality of boundary surfaces between the insulation layers and that have an inner circumferential side end portion located relatively near a central area of each of the insulation layers and an outer circumferential side end portion located relatively near an outer edge area of each of the insulation layers, and an inner circumferential side via hole conductor that connects the respective inner circumferential side end portions of coil conductors adjacent in a lamination direction to each other;

the first coil further includes an outer circumferential side via hole conductor that connects the respective outer circumferential side end portions of coil conductors adjacent in the lamination direction to each other, and in the first coil, the plurality of coil conductors are connected in series through the inner circumferential side via hole conductor and the outer circumferential side via hole conductor in an alternating manner;

the coil conductors for the second coil include a coil conductor that is laminated so as to be interposed between two coil conductors, of the coil conductors for the first coil, that are connected to each other by the inner circumferential side via hole conductor; and in the first coil, the outer circumferential side via hole conductor is provided so as to pass through only one insulation layer.

2. The common mode choke coil according to claim 1, wherein the second coil further includes an outer circumferential side via hole conductor that connects the respective outer circumferential side end portions of coil conductors adjacent in the lamination direction to each other, and in the second coil, the plurality of coil conductors are connected in series through the inner circumferential side via hole conductor and the outer circumferential side via hole conductor in an alternating manner;

the coil conductors for the first coil include a coil conductor that is laminated so as to be interposed between two coil conductors, of the coil conductors for the second coil, that are connected to each other by the inner circumferential side via hole conductor; and in the second coil, the outer circumferential side via hole conductor is provided so as to pass through only one insulation layer.

3. The common mode choke coil according to claim 1, wherein a form of the first coil and a form of the second coil are symmetrical relative to the lamination direction.

* * * * *